United States Patent [19]

Drummond

[11] Patent Number: 4,481,896

[45] Date of Patent: Nov. 13, 1984

[54] FLEXIBLE MATERIAL STACKER

[75] Inventor: Todd Drummond, Metairie, La.

[73] Assignee: Wembley Industries, Inc., New Orleans, La.

[21] Appl. No.: 339,216

[22] Filed: Jan. 13, 1982

[51] Int. Cl.[3] ..... D05B 33/00

[52] U.S. Cl. ..... 112/121.29; 198/653; 271/85; 414/744 A

[58] Field of Search ..... 414/744 A; 112/121.29, 112/121.12, 121.11, 121.15, 121.22, 121.27, 65; 38/143; 198/653; 271/85, 277, 268

[56] References Cited

U.S. PATENT DOCUMENTS

| | | | |
|---|---|---|---|
| 2,811,267 | 10/1957 | Bock | 414/744 A |
| 3,349,732 | 10/1967 | Perrella et al. | 112/65 |
| 3,537,702 | 11/1970 | Kosrow et al. . | |
| 3,675,604 | 7/1972 | Frost . | |
| 3,695,195 | 10/1972 | Frost . | |
| 3,701,328 | 10/1972 | Frost . | |
| 3,824,833 | 7/1974 | Bachmann | 414/744 A X |
| 4,042,122 | 8/1977 | Espy et al. | 414/744 A X |
| 4,102,284 | 7/1978 | Rohr . | |
| 4,113,115 | 9/1978 | Yoshio | 414/744 A X |

FOREIGN PATENT DOCUMENTS

| | | | |
|---|---|---|---|
| 303220 | 1/1929 | United Kingdom | 271/85 |

OTHER PUBLICATIONS

Descriptive Literature of Adler Model 971/972, Kochs Adler AG, Bielefeld, West Germany.

*Primary Examiner*—Werner H. Schroeder
*Assistant Examiner*—Andrew M. Falik
*Attorney, Agent, or Firm*—Beveridge, DeGrandi & Kline

[57] ABSTRACT

An apparatus for handling flexible material positioned with two distal portions thereof accessible to the apparatus has a frame, first and second arms each having first and second ends, with the first ends having pivotal mountings on the frame and the second ends having gripping fingers adapted for gripping and subsequently releasing one of the distal portions of flexible material. The arms can be rotated about the pivotal mountings from first positions in which the fingers can grip their respective distal portions of flexible material to second positions in which gripped material is extended to substantially its full length. The material is received in a rack upon release by the fingers when the arms are in their second position. The apparatus operates according to an automatic control.

7 Claims, 10 Drawing Figures

FIG. 4
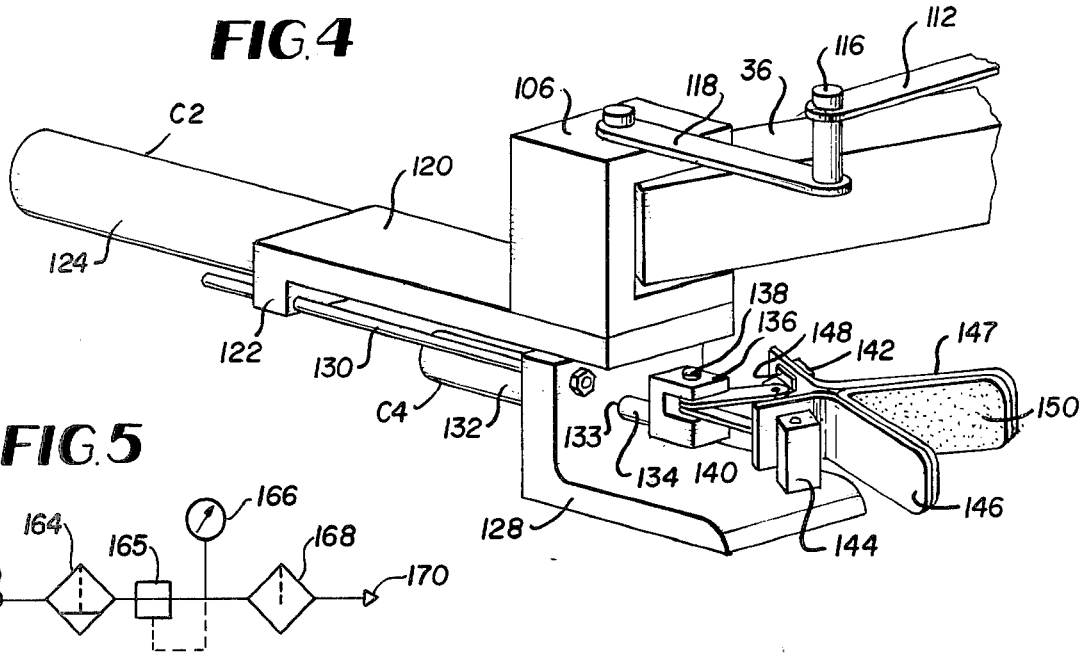
FIG. 5
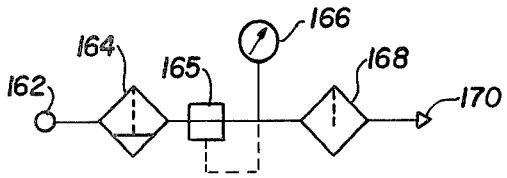
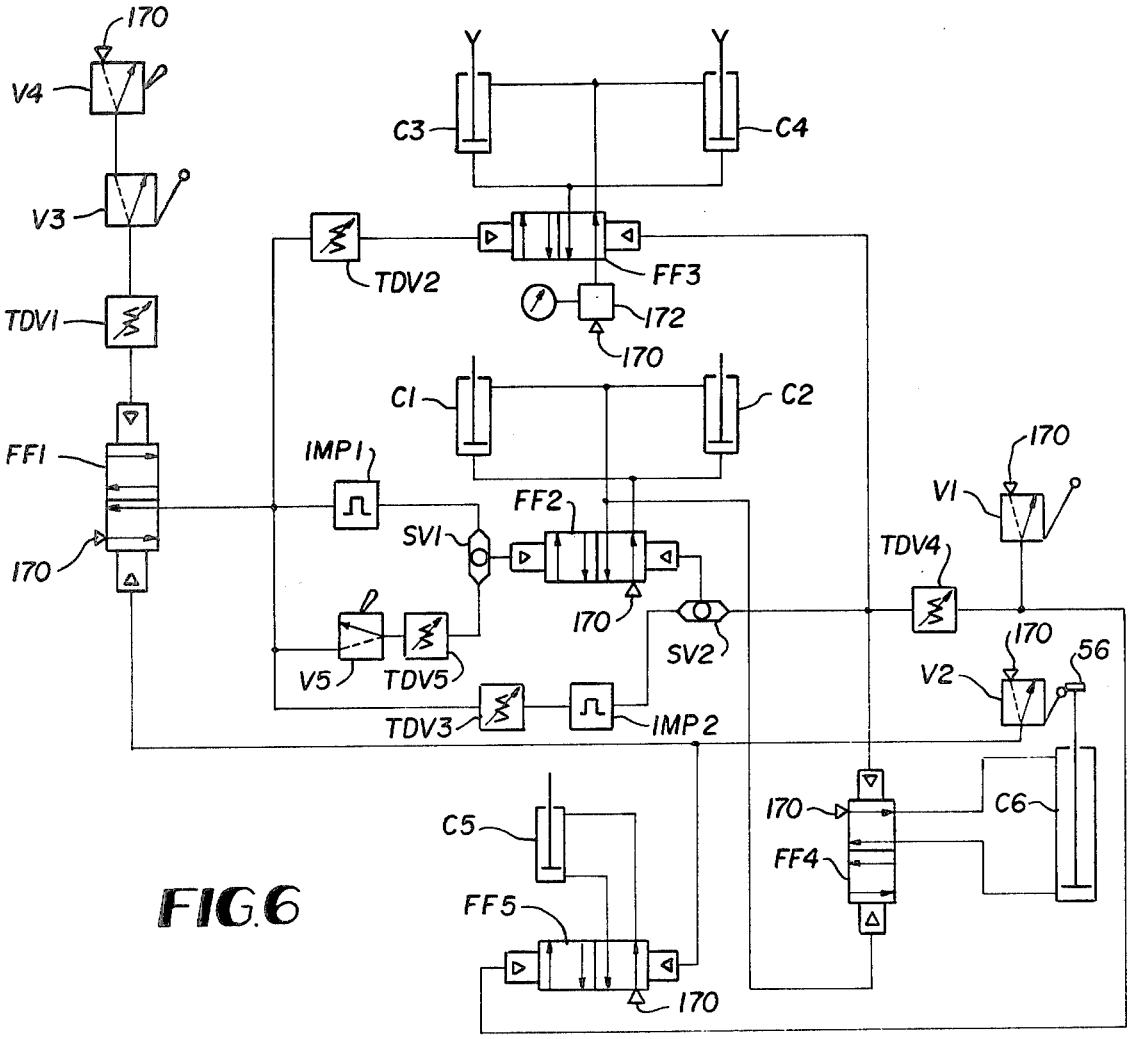
FIG. 6

FLEXIBLE MATERIAL STACKER

BACKGROUND OF THE INVENTION

This invention relates to improvements in apparatus and methods for stacking flexible material such as neckties and the like.

In the manufacture of neckties, cloth having the desired appearance is cut into patterns which are wider than the finished necktie. The extra width allows the two sides to be folded back and connected with a longitudinal seam.

Prior to seaming, the ends of the necktie material are provided with what is known as "tipping", which serves as a lining for both the wide and narrow tips of the necktie. The tipping additionally aids in the formation of the desired points on the ends of the necktie.

It is known for tipping to be applied by automatic sewing apparatus. For instance sewing apparatus as manufactured by Kochs Adler A. G. of Bielefeld, West Germany, Adler's Models Nos. 971 and 972.

In the Adler apparatus, a central carousel unit has six outwardly radiating templates. An operator sits at the Adler machine with a supply of tipping fabric and tie fabric close at hand. The carousel rotates in stages of 60°, so that each rotation presents a new template directly in front of the operator. The operator positions the end of the tie fabric and the tipping material in the template. Alternate ones of the templates are sized for wide ends of ties and narrow ends of ties.

Thus an operator may start with a wide end tipping material and wide end tie fabric, which he or she positions in the wide end template. The central portion of the tie fabric extending from the wide end is allowed to drape loosely around the central portion of the carousel. Then the operator causes the carousel to rotate by 60° and the narrow end of the tie fabric and its tipping material are inserted in the narrow end template. As the carousel continues to rotate, a sewing machine sews the tie fabric and tipping material which protrude from the outer periphery of the templates and a trimming machine cuts off excess material and severs the sewing thread. Upon further rotation of the carousel, the templates open and the tie is available for removal. Heretofore this removal has been performed manually.

The present invention provides a method and apparatus by which the ties can be removed from the Adler tie tipping machine without requiring human intervention.

It is known to provide automatic machinery for removing sewn goods from sewing machines. For instance, such apparatus is disclosed in the following U.S. Pat. Nos.

3,537,702, Kosrow et al.
3,675,604, Frost
3,695,195, Frost
3,701,328, Frost
4,102,284, Rohr None of the prior U.S. patents disclose a method or apparatus suggestive of the present invention.

In particular, none of the above cited patents provide for gripping the sewn material in two locations to remove it from the sewing machine and stack it neatly.

The orderly stacking of the sewn goods is particularly important because further operations must be carried out to complete the necktie manufacturing process and a neat and orderly presentation of the workpieces to later operators in the manufacturing process increases the speed with which they can function.

Thus it has been found that the use of the apparatus of the present invention increases production rates surprisingly. Not only is the need for manual removal of ties from the Adler machine eliminated, but also the speed with which later production steps can be carried out is increased. Furthermore, it has been found that operators of the Adler tie tipping machines tend to increase their production rates when the present invention is employed to remove and stack the tipped ties, even though the invention is used downstream of their operations.

SUMMARY OF THE INVENTION

The present invention includes an apparatus for handling flexible material positioned with two distal portions thereof accessible to the apparatus. The apparatus has a frame, first and second arms each having first and second ends, with the first ends having pivotal mountings on the frame and the second ends having gripping means adapted for gripping and subsequently releasing one of the distal portions of flexible material. The apparatus has a means for rotating the arms about the pivotal mountings from first positions in which the gripping means can grip their respective distal portions of flexible material to second positions in which gripped material is extended to substantially its full length, and a means for receiving the material from the gripping means upon release of the material by the gripping means when the arms are in their second position.

A control means is provided for causing the gripping means to grip their respective distal portions of the material when the arms are in the first position, then for causing the rotating means to pivot the arms to their second position, and then for causing the gripping means to release the distal portions, whereby the material is received by the receiving means. The control means then causes the rotating means to pivot the arms back to their first position.

Preferably the apparatus includes means for moving the gripping means with respect to the arms and wherein the control means includes means for causing a movement of each of the gripping means elongatingly axially of said arms when the arms are in the first position prior to the gripping means gripping their respective distal portions and for causing a foreshortening axial movement after the gripping and prior to causing the rotation of the arms from the first position to the second position.

Preferably the gripping means are pivotally mounted on the arms and a parallel linkage from the gripping means to the frame rotates the gripping means with respect to the arms as the arms rotate between the first and second positions.

Desirably, the means for receiving the material from the gripping means includes a rack mounted on the frame, located at a lower level than but in substantially the same plane as the gripping means when the arms are in the second position. The receiving means can also include an auxiliary rack pivotable about a horizontal axis between a horizontal rack position and a vertical rack position and vertically movable such that the horizontal rack position is between the first mentioned rack and the material when the material is gripped by the gripping means and when the arms are in their second position, means for vertically moving the auxiliary rack and means for pivoting the auxiliary rack, wherein the control means includes means for causing the auxiliary rack to move upwardly and to pivot to the horizontal rack position prior to the release of the material when the arms are in the second position so that upon its release, the material will be received on the auxiliary rack. The control means can also include means for causing the auxiliary rack to move downwardly after the release and then to pivot to the vertical rack position thereby depositing the material on the first mentioned rack.

Preferably the control means includes an initiating switch operable to generate a signal to initiate operation of the control means and means connected to the initiating switch for receiving the signal and for delaying the signal prior to proceeding with later steps controlled by the control means.

The invention includes the combination of the aboveitemized apparatus and an apparatus for sewing lining fabric on the flexible material in which the sewing apparatus includes means for providing access to the two distal portions of the flexible material.

BRIEF DESCRIPTION OF THE DRAWINGS

Other objects and advantages of the invention will become apparent from the following detailed description, as taken in connection with the accompanying drawings in which:

FIG. 4 is an enlarged perspective view of the tie tip gripping fingers used in the embodiment of FIG. 1;

FIG. 5 is a schematic diagram of a portion of the pneumatic circuit employed in the operation of the embodiment of FIGS. 1 and 9;

FIG. 6 is a schematic diagram of the remainder of the pneumatic circuit employed in the operation of the embodiment of FIG. 1;

DETAILED DESCRIPTION OF THE EMBODIMENTS

Figure 1:
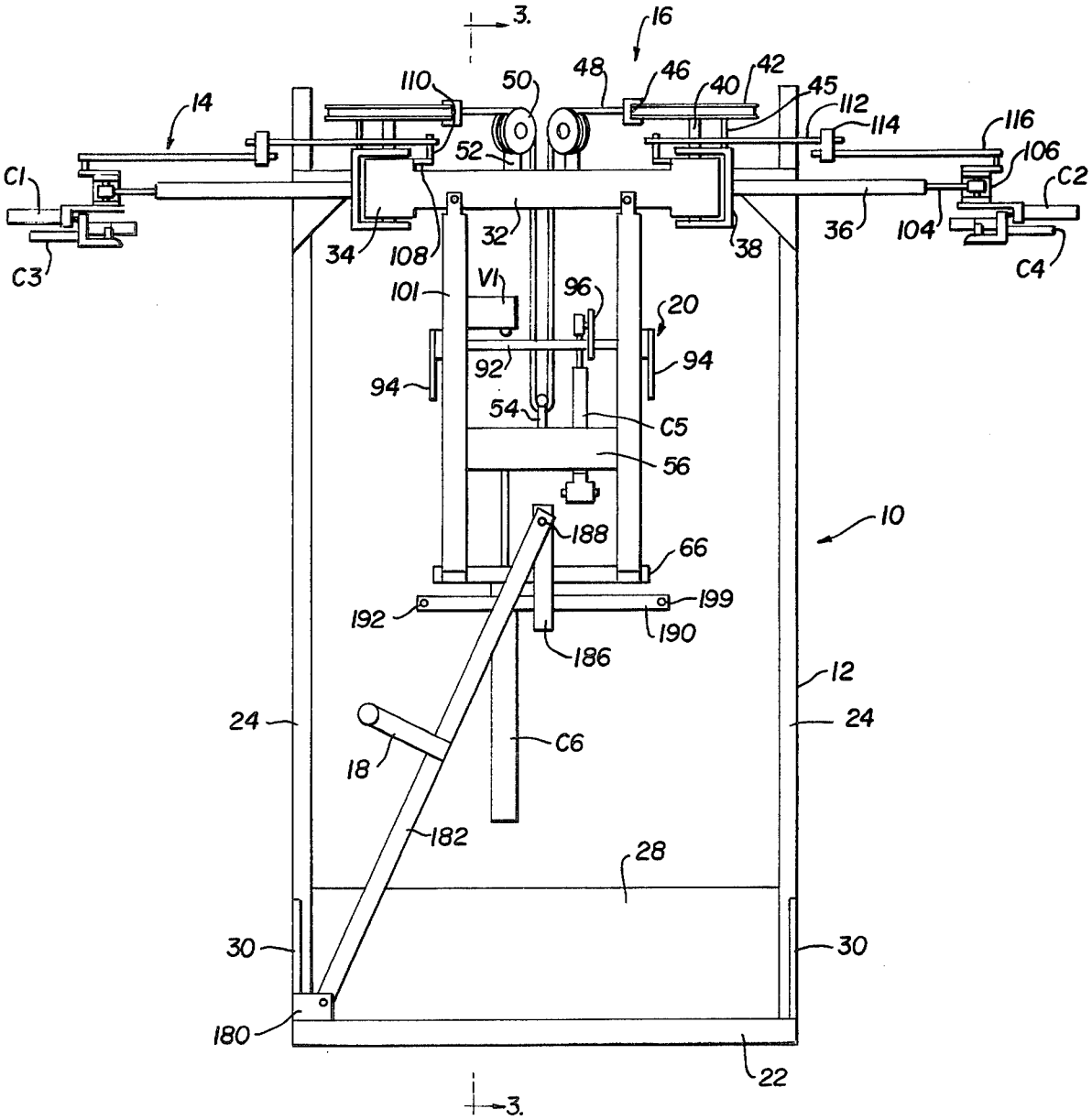
FIG. 1 is a front elevational view of the apparatus according to a preferred embodiment.
Figure 2:
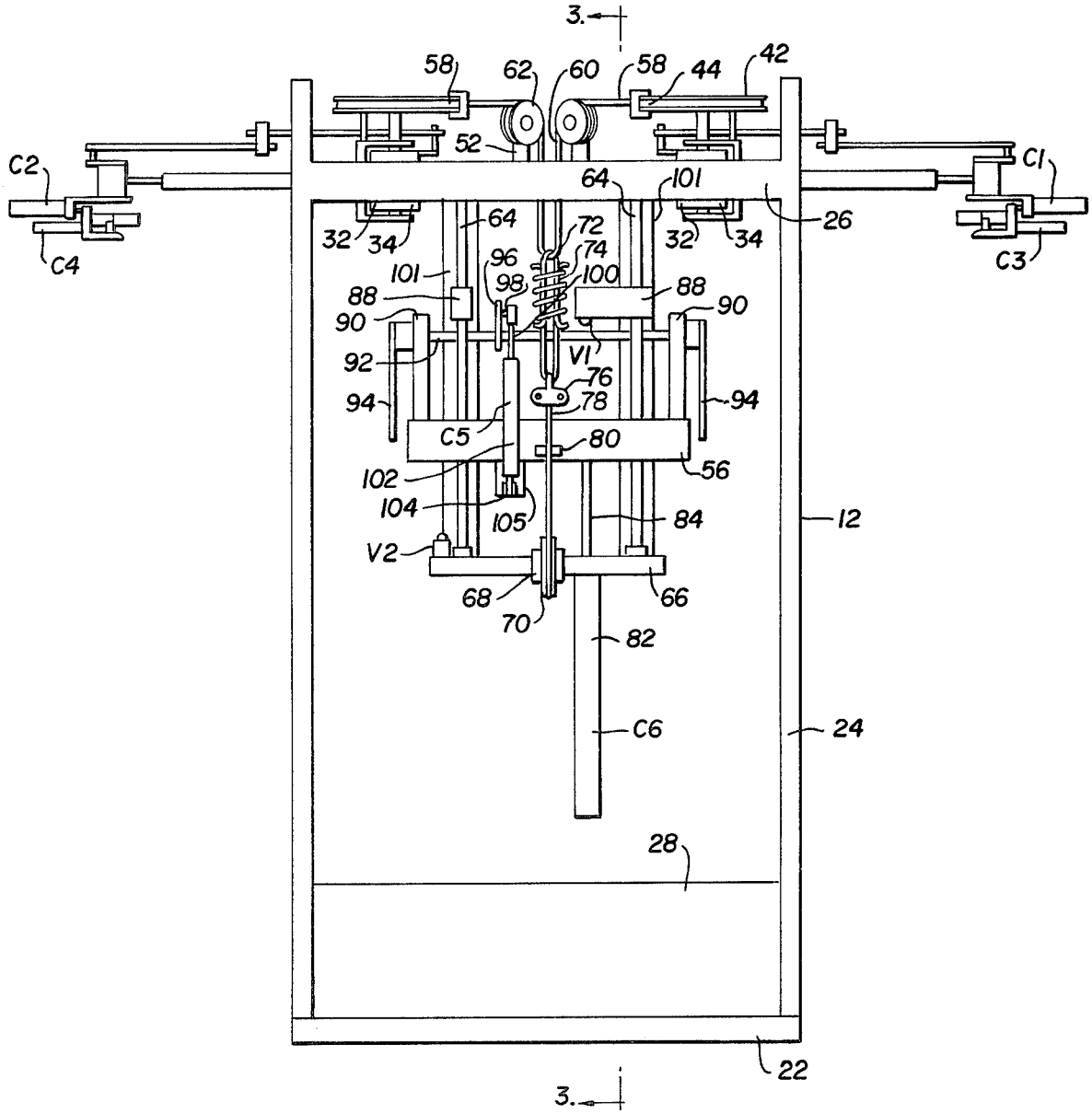
FIG. 2 is a rear elevational view of the embodiment of FIG. 1.
Figure 3:
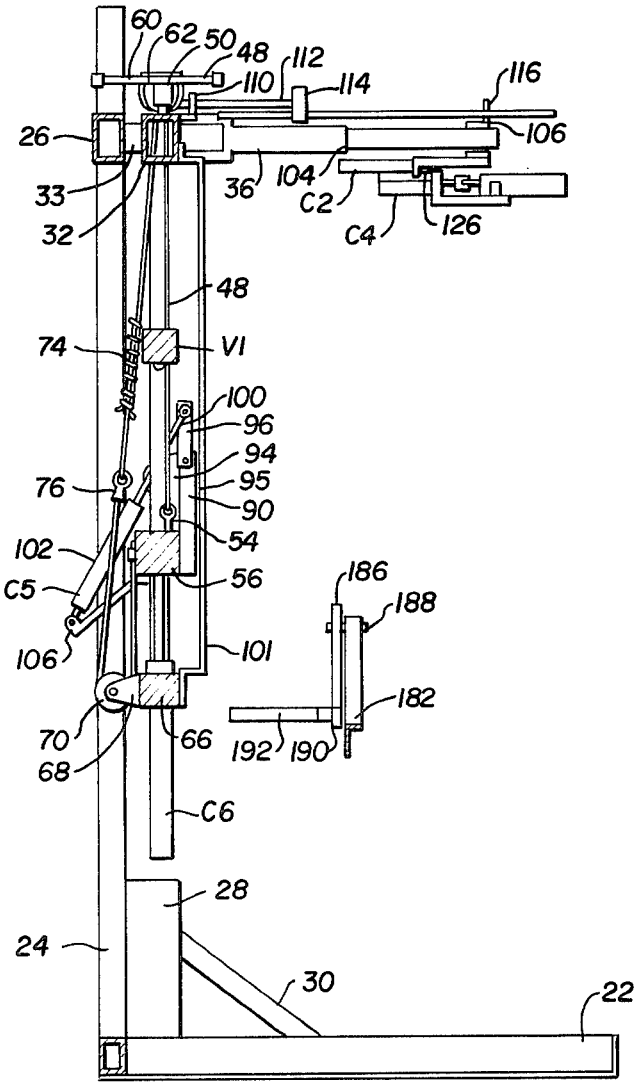
FIG. 3 is a vertical sectional view taken substantially along lines 3—3 of FIGS. 1 and 2, looking in the direction of the arrows.

As can be seen from FIGS. 1, 2 and 3, the apparatus 10 of this embodiment includes a frame 12, an arm assembly 14, an arm assembly rotator 16, a tie receiving rack assembly 18 and an auxiliary rack assembly 20.

The frame 12 includes a rectangular base 22 and two vertical support elements 24 interconnected to and at opposite sides of base 22. Vertical support elements 24 are connected by horizontal beam 26 near their tops. Vertical support elements 24 support U-shaped plate 28, used for mounting the control components, to be described hereinafter in connection with FIGS. 5 and 6.

Vertical support elements 24 are reinforced by braces 30.

Ear bracket 180 is mounted on base 22 of frame 12 as a portion of the tie receiving rack assembly 18. Bracket 180 has pivoted thereto support arm 182. Support arm 182 is pivotable between the position shown in FIG. 1 and a position about 80° counter clockwise thereof. A handle 184 is provided to facilitate the pivoting by an operator standing to the left of the apparatus from the view of FIG. 1.

Drop bar 186 is pivoted as at 188 to the other end of arm 182, and hangs vertically downward, regardless of the position of arm 182. Member 190 extends horizontally from the bottom of drop bar 186 and has transverse racks 192 substantially perpendicular thereto, as seen in FIGS. 3 and 8.

Figure 8:
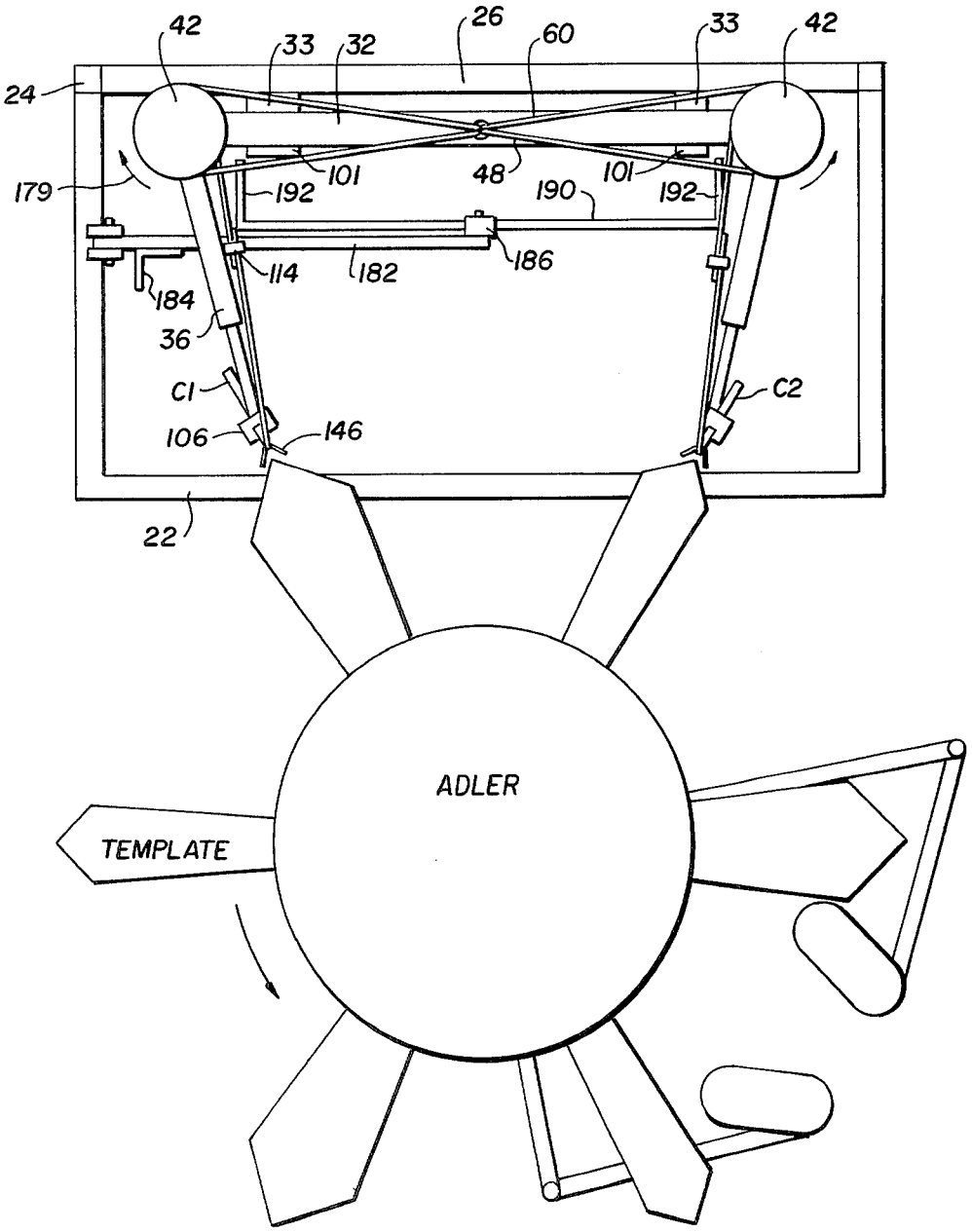
FIG. 8 is a schematic top view of the apparatus of the embodiment of FIG. 1 in the ready position in combination with the Adler sewing machine.

As best seen in FIGS. 3 and 8, horizontal beam 26 has cantilevered therefrom support beam 32 by way of a pair of connecting links 33. As best seen in FIG. 1, support beam 32 has widened end portions 34.

A storage area can conveniently be provided by mounting a bracket on support beam 32 perpendicular thereto. Such a support beam is not shown in the drawings, but it can, together with the tops of vertical support elements 24, support a flat surface providing storage area for the machine operator's supplies.

Arm assemblies 14 and the arm assembly rotator 16 are mounted on support beam 32.

Arm assembly 14 includes arm 36 which has a first end 38 pivotally mounted on widened end portion 34 by axle 40. Sprocket 42 is also mounted on axle 40. Arm 36 is rotatable with respect to axle 40, but sprocket 42 is not. Furthermore, rotation between arm 36 and sprocket 42 is prevented by eccentric link 45.

Sprocket 42 has chain 44 trained around it. The forward end 46 of chain 44 is connected to forward cable 48. As will be apparent from FIG. 1, the hereinabove referenced assembly of an arm 36, axle 40, sprocket 42 and chain is provided in duplicate. Thus there are two chains, each having a forward end 46 connected to an end of cable 48. Towards the center of support beam 32 are two forward pulleys 50 mounted on support blocks 52. The portion of cable 48 extending from each forward end 46 of chains 44 is trained over one of the pulleys and the midportion of the cable is connected at its lower extent through eye 54 to traveling beam 56.

Referring to FIG. 2, each chain 44 extending around the rear of a sprocket 42 is connected at its rear end 58 to rear cable 60. Rear cable 60 is trained over rear pulleys 62, also mounted on blocks 52.

Suspended from support beam 32 are a pair of vertical rods 64, which have cross bar 66 mounted on their lower extremities. Pulley 70 is mounted by way of bracket 68 on cross bar 66. Lower loop 72 of rear cable 60 is connected by way of spring 74 and connector 76 to lower cable 78. Lower cable 78 is trained around pulley 70 up to clamp 80 which affixes it to traveling beam 56.

As best seen in FIG. 3, bumper plates 101 extend between support beam 32 and cross bar 66, and provide backing surfaces beyond the ends of racks 192.

Traveling beam 56 is provided with openings which slidingly receive vertical rods 64 so that traveling beam 56 can move vertically, guided by vertical rods 64.

Mounted on cross bar 66 is cylinder 82 of pneumatic ram C6. Piston rod 84 of ram C6 passes through an opening in cross bar 66 and is rigidly engaged at 86 with traveling beam 56. Vertical rods 64 have rigidly mounted thereon stops 88, one of which is provided with pneumatic cam operated valve V1 in such a position as to be opened by traveling beam 56 when beam 56 is at its uppermost elevation. Pneumatic cam operated valve V2 is mounted on the top of cross bar 66 in such a position that when traveling beam 56 is at its lowermost elevation, valve V2 is opened.

Auxiliary rack assembly 20 is mounted on traveling beam 56. The ends of traveling beam 56 each have a post 90 mounted thereon. Posts 90 have journaled therein shaft 92, which has auxiliary rack support plates 94 on the ends thereof. Plates 94 have a rack edge 95 of a length sufficient to extend (in FIG. 3) to the right sufficiently past bumper plates 101 to receive the tie, as will be more apparent hereinafter. Crank lever 96 is rigidly mounted on shaft 92 between posts 90. The end 98 of piston rod 100 of pneumatic ram C5 is rotatably connected to crank lever 96. Bracket 105 is rigidly mounted on traveling beam 56 and cylinder 102 of ram C5 is pivotally mounted as at 104 to bracket 105.

By this arrangement, the extension of piston rod 100 causes crank lever 96 to rotate so that auxiliary rack support plates 94 are in a vertical position, as seen in FIG. 3. The retraction of piston rod 10 rotates them out to a horizontal position extending to the right of bumper plates 101 of FIG. 3.

As was previously stated, arms 36 are journaled on axles 40. Arms 36 are made telescoping as at 104 to provide for variable length arms. Pivotally mounted on the second end of arm 36 is hand bracket 106.

Widened end portion 34 of support beam 32 has an ear 108 provided with post 110 on which is journaled parallel arm 112. Parallel arm 112 is also adjustably variable in length as at 114 so as to correspond with adjustments in the length of arm 36. Parallel arm 112 is also pivotally connected to hand bracket 106 as at 116, thereby providing a parallel linkage between hand bracket 106 and widened end portion 34 on frame 12.

The details of the gripping member mounted on the end of arm 36 can be seen with reference to FIG. 4. As noted previously, both arm 36 and parallel arm 112 are rotatably connected to hand bracket 106. This can conveniently be accomplished by providing a transverse lever 118 rigidly mounted on hand bracket 106. Parallel arm 112 is pivotally mounted to traverse lever 118 as by journalling on post 116. Arm 36 is, of course, rotatably mounted within hand bracket 106. The result is the parallel linkage arrangement of arm 36 and parallel arm 112 between support beam 32 and hand bracket 106. Thus as arm 36 rotates with respect to frame 12, hand bracket 106 rotates with respect to arm 36.

Rigidly mounted on the base of hand bracket 106 is plate 120. Plate 120 has a rearwardly depending portion 122 to which cylinder 124 of pneumatic ram C2 is rigidly engaged. The distal end of piston rod 126 (see FIG. 1) is attached to L-shaped plate 128. Also attached to L-shaped plate 128 are aligning rods 130 which are slidably received in portion 122 of plate 120.

Rigidly mounted on L-shaped plate 128 is cylinder 132 of pneumatic ram C4. Piston rod 134 of pneumatic ram C4 extends slidably through an opening 133 in L-shaped plate 128 and has its terminal point attached to pivot pin bracket 136. Pivot pin 138 passes through openings in bracket 136 and links 140.

Upstanding from L-shaped plate 128 are a pair of posts 142 which have blocks 144 journaled thereon. Secured to one face of each block 144 is the outer portion of plate-like finger 146. Two such fingers are provided, each of a sheet material and each having a transverse bend therein, adjacent the blocks 144. Brackets 148 attached to the inside of the shorter portions of fingers 146 are pivotally mounted to links 140. The inside of the longer portion 147 of the fingers is provided with a layer of resilient material such as fabric or foam rubber 150.

Thus when piston rod 134 of cylinder C4 is extended, pivot pin bracket 136 is moved nearer to fingers 146 and links 140 exert force against the shorter portions of the fingers forcing the shorter portions outward, closing the fingers. When piston rod 134 is retracted, the shorter portion of fingers 146 are pulled together causing the longer portion 147 to separate, opening the fingers.

As was stated previously, the control equipment can can conveniently be mounted on U-shaped plate 28, or elsewhere, as may be desired. In the preferred embodiment the apparatus is a pneumatic system, and reference has been made hereinabove to pneumatic rams. It is understood, however, that those of ordinary skill in the art will be able to modify the specific disclosure herein provided to operate the apparatus with electrical, electronic, or hydraulic circuitry without departing from the inventive concept hereof.

Pneumatic operation has been preferred because the Adler tie tipping machine uses pneumatic components and, therefore, pressurized air supplies are conveniently available.

Referring to FIG. 5, there is schematically shown a typical air supply for use in the invention. Air from air supply source 162 is filtered in unit 164, regulated at 165 as read by meter 166, and lubricated at 168. The resulting air supply is available for application to various components in the system from a manifold 170. In FIG. 6, valve V4 serves as a manual toggle-operated on-off switch for the system. Manifold 170 provides its input, and its output is tied to the input of cam-operated valve V3. Preferably valve V3 is mounted on the Adler sewing machine adjacent the rotatable carousel thereof, so that cams on the carousel can open valve V3 to start one cycle of operation. The output of valve V3 is applied to the input of time delay valve TDV1.

This circuit employs various time delay valves which operate to receive a signal at their inputs and at some specified period later open to provide an output signal at their outputs. The delay periods of the time delay valves are individually selected and are characteristic of the valves. Preferably valve TDV1 has a delay period such that it produces its output signal when the two templates for a single tie are in position for tie removal and are open.

The output of valve TDV1 is applied as input to flip flop FF-1. The flip flops used in this circuit receive input signals which change the state of the flip flop so as to transfer an input from manifold 170 from one output to another. In its quiescent state, FF-1 has no output. When the output of TDV1 is input to FF-1, the pressure from manifold 170 to FF-1 is applied as an output on line 171. This pressure is applied by line 171 to time delay valve TDV2, impulse valve IMP1, toggle switch valve V5 and time delay valve TDV3. The inputs to TDV2 and TDV3 begin the running of their preselected time delays. The input to V5 will be discussed hereinafter.

Impulse valve IMP1 converts the substantially constant pressure from manifold 170 to an impulse which is transmitted past shuttle valve SV1 to flip flop FF2. This causes the input from manifold 170 to FF2 to be applied to the cylinders 124 of pneumatic rams C1 and C2, thereby extending their piston rods. In FIG. 4, this action is seen as the movement of L-shaped plate 128 away from portions 122 of plate 120.

The time delay of TDV2 is selected to expire upon completion of the extension of C1 and C2. The ouput of TDV2 transfers flip flop FF3 to the right. The input from manifold 170 to flip flop 3 is regulated as by pressure regulator 172 so as to provide an extra control of the finger pressure generated by rams C3 and C4. Upon expiration of TDV2, the regulated pressure signal is applied to the cylinders C3 and C4 in such a manner as to extend the piston rods 134, thereby closing fingers 146.

The time delay of valve TDV3 expires upon the completion of the extension of rams C3 and C4. Upon its expiration, the substantially constant pressure output of TDV3 is converted by impulse valve IMP2 to a momentary impulse which passes shuttle valve SV2 and is applied as an input the right hand side of flip flop FF2 to transfer it to the left, thereby applying pressure to rams C1 and C2 to retract their piston rods. In FIG. 4, the action is seen as the movement of L-shaped plate 128 toward portion 122 of plate 120. The expiration of TDV3 also causes an input to the bottom of flip flop FF 4 so that the pressure from manifold 170 is applied to the cylinder of ram C6, thereby causing it to extend its piston rod. As the piston rod 84 of cylinder C6 extends, it elevates traveling beam 56, applying tension to cable 60, thereby rotating sprocket 42 and arms 36. This action can be seen in FIG. 1 as the movement of traveling beam 50 upward. By virtue of the linkage of arm assembly rotator 16 to beam 56, arms 36 are rotated in the direction of arrows 179, seen in FIG. 8.

When traveling beam 56 reaches stops 88 it opens valve V1. This applies the pressure from manifold 170 to time delay valve TDV4 and the left side flip flop FF5, transferring flip flop FF5 to the right and causing the application of pressure from manifold 170 to the cylinder 102 of ram C5 so as to retract its piston rod 100. This action can be seen in FIG. 3 as the pivoting of plates 94 to a horizontal position extending to the right, past bumper plates 101.

Upon the expiration of the delay of valve TDV4, a signal is applied to the right side of flip flop FF3, transferring it to the left and causing the application of pressure to the cylinders of rams C3 and C4 to retract their piston rods, thereby opening fingers 146. The signal from TDV4 is also applied to the top of flip flop FF4 to cause the pressure from manifold 170 to be applied to ram C6 to cause its piston rod 84 to retract.

The retraction of piston rod 84 eventually results in traveling beam 56 actuating valve V2, thereby applying pressure from manifold 170 to the right hand side of flip flop FF5. This pressure shifts FF5 to the left and causes the pressure from manifold 170 to extend the piston rod 100 of ram C5. This action causes the clockwise rotation of plates 94 to their vertical position seen in FIG. 3.

Valve V2 also applies a signal to the bottom of flip flop FF1 to return it to its original state, ready for the next cycle to be initiated by valve V3.

Valve V5 and valve TDV5 provide an optional extra step when short ties are being sewn on the Adler tipping machine. The toggle switch valve V5 is manually operable. In the short tie mode, valve V5 is open. Upon the expiration of TDV1, the initial signal from flip flop FF1 is applied to time delay valve TDV5 simultaneously with the signals applied to time delay valves TDV2 and TDV3 and impulse valve IMP1. The delay of time delay valve TDV5 is selected to expire shortly before the piston rod 84 of ram C6 is fully extended. Upon its expiration TDV5 applies a signal to the left side of flip flop FF2 to shift FF2 to the right. This results in the application of pressure from manifold 170 to cause rams C1 and C2 to extend their piston rods. These extensions decrease the distance between the fingers 146 of the two arms as they rotate outwardly to their furthest extension from one another. This prevents the stretching of the tie when the short tie mode has been in operation. The expiration of time delay valve TDV4 applies a signal to the right hand side of flip flop FF2 to cause the retraction of the piston rods of cylinders C1 and C2 as the tie ends are released by the fingers 146.

Figure 7:
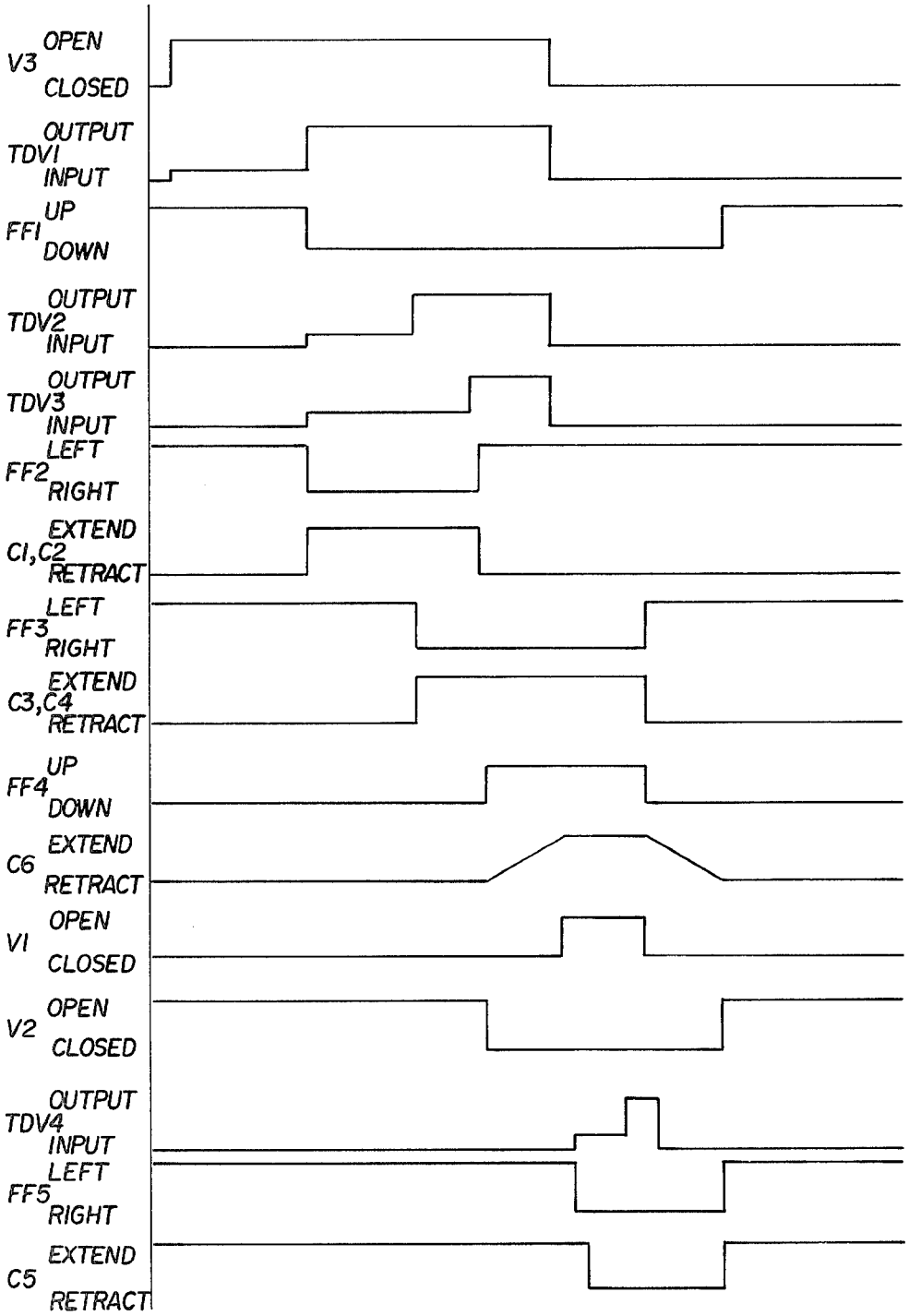
FIG. 7 is a timing circuit diagram showing the condition of the various components of the system during one complete cycle of operation of the apparatus of the embodiment of FIG. 1.

The operation of the system will be discussed with reference to the timing diagram of FIG. 7, as well as FIGS. 1–6 and 8.

At the initial "ready" condition as shown in FIG. 8, the arms 34 have been rotated toward one another. The condition of the components is seen at the left in FIG. 7, or is derivable therefrom.

Upon the actuation of valve V3 by the Adler machine, TDV1 begins its delay period. At the expiration of this delay TDV1 has an output which is input to FF1, shifting FF1 from UP to DOWN. This shift causes a signal to be applied to TDV2, TDV3, and, via IMP1, to FF2. Additionally, if V5 is open for the short tie mode, TDV5 begins its delay period.

The signal to FF2 shifts FF2 from LEFT to RIGHT and causes the extension of the piston rods of rams C1 and C2 to extend the fingers 146 closer to the templates of the Adler machine.

The expiration of TDV2 sends a signal to FF3, shifting it from LEFT to RIGHT and causing the extension of the piston rods of rams C3 and C4, closing the fingers 146 to grip the exposed tie ends in the open templates.

The expiration of TDV3 sends an impulse which shifts FF2 from RIGHT to LEFT and shifts FF4 from DOWN to UP. The transfer of FF2, withdraws the fingers from the templates of the Adler machine. The transfer of FF4 begins the elevation via C6 of traveling beam 56. The linkage of beam 56 via rear cables 60, rear pulleys 62, sprocket 42 and chains 44 to arms 36 causes the arms to rotate outwardly in the direction of arrows 179 in FIG. 8. This results in an increase in the distance from the fingers 146 of one arm 36 to the fingers 146 of the other arm, thus extending the tie to substantially its full length. Furthermore, this movement causes the extended tie to be located substantially parallel to the beam 32, and over the racks 192 and the receiving rack assembly 18. If valve V5 is open, TDV5 expires shortly before the arms are fully rotated, so that rams C1 and C2 extend their piston rods, shortening the extension distance to prevent the stretching of the tie.

The parallel linkage of arms 36 and parallel arm 112 causes the fingers 146 to rotate as the arms 36 rotate, so that the longer portions 142 of fingers 146 are substantially parallel to the extended tie.

When cam C6 has been fully extended, traveling beam 56 opens valve V1 mounted on stops 88, thereby transferring FF5 from LEFT to RIGHT and beginning the delay of TDV4. The transfer of FF5 retracts the piston rod of cam C5, causing auxiliary rack plates 94 to be rotated to their horizontal rack position directly under the extended tie.

Then valve TDV4 expires shifting FF3 from RIGHT to LEFT, which opens the fingers to release the tie onto auxiliary rack plates 94.

The expiration of TDV4 also shifts FF2 from UP to DOWN, so that traveling beam 56 is lowered. Since the auxiliary rack plates 94 are supported on traveling beam 56, the lowering also results in the tie being lowered to the rack 192 of receiving rack assembly 18.

When traveling beam 56 reaches its lowermost position, valve V2 is opened, shifting FF5 from RIGHT to LEFT, and pivoting the rack plates 94 from their horizontal rack position down to a vertical rack position, depositing the tie on rack 192 of receiving rack assembly 18.

The descent of traveling beam 56, of course, also causes a tension to be applied to forward cable 48, so that arms 36 are rotated back to the ready position. The opening of valve V2 also shifts FF1 from DOWN to UP, resetting it for the next cycle. After a number of cycles of operation, a plurality of ties are neatly stacked on racks 192 and can be easily removed as a bundled stack for transfer to the next operation to be performed.

An operator can remove the stack by pivoting tie receiving rack assembly 18 outwardly by pulling on handle 184. The stack of ties on rack 192 will remain horizontal throughout this movement, due to the pivoted linkage of drop bar 186 to support arm 182.

Figure 9:
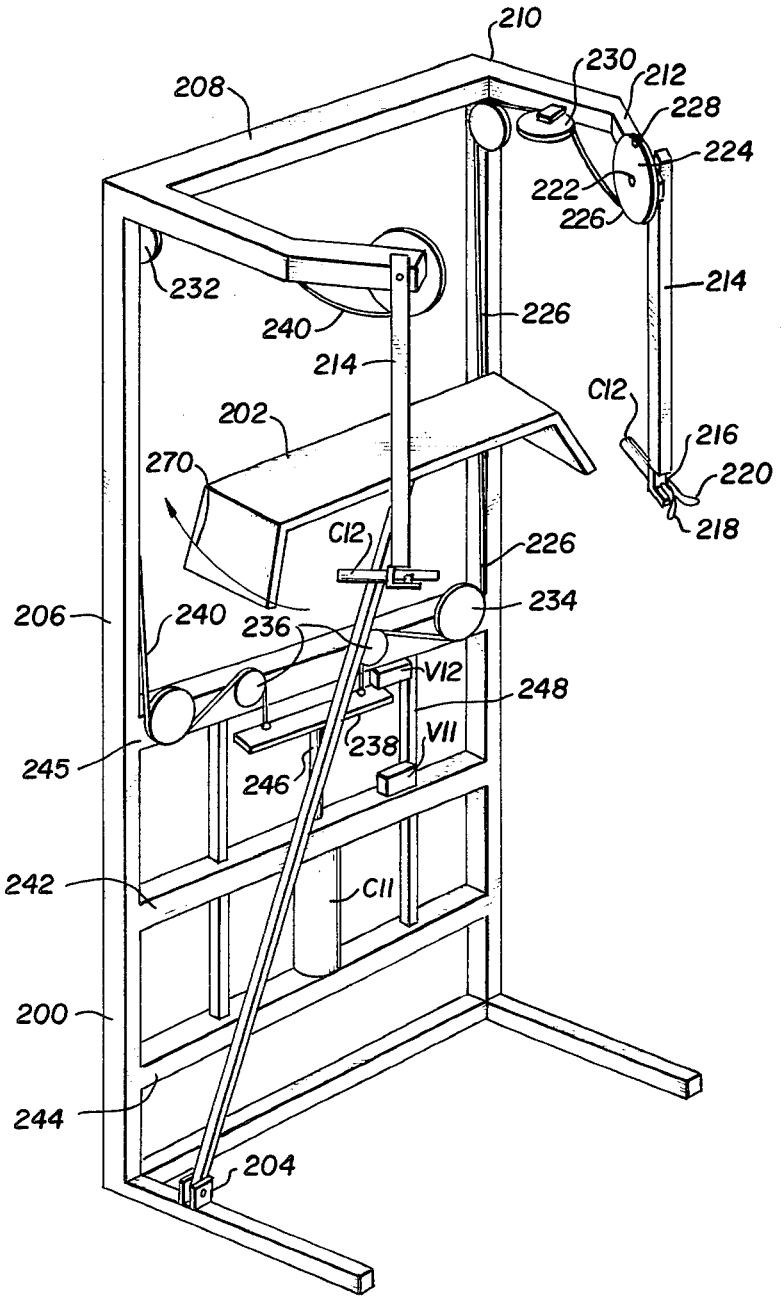
FIG. 9 is a perspective view of an alternative embodiment of the apparatus.
Figure 10:
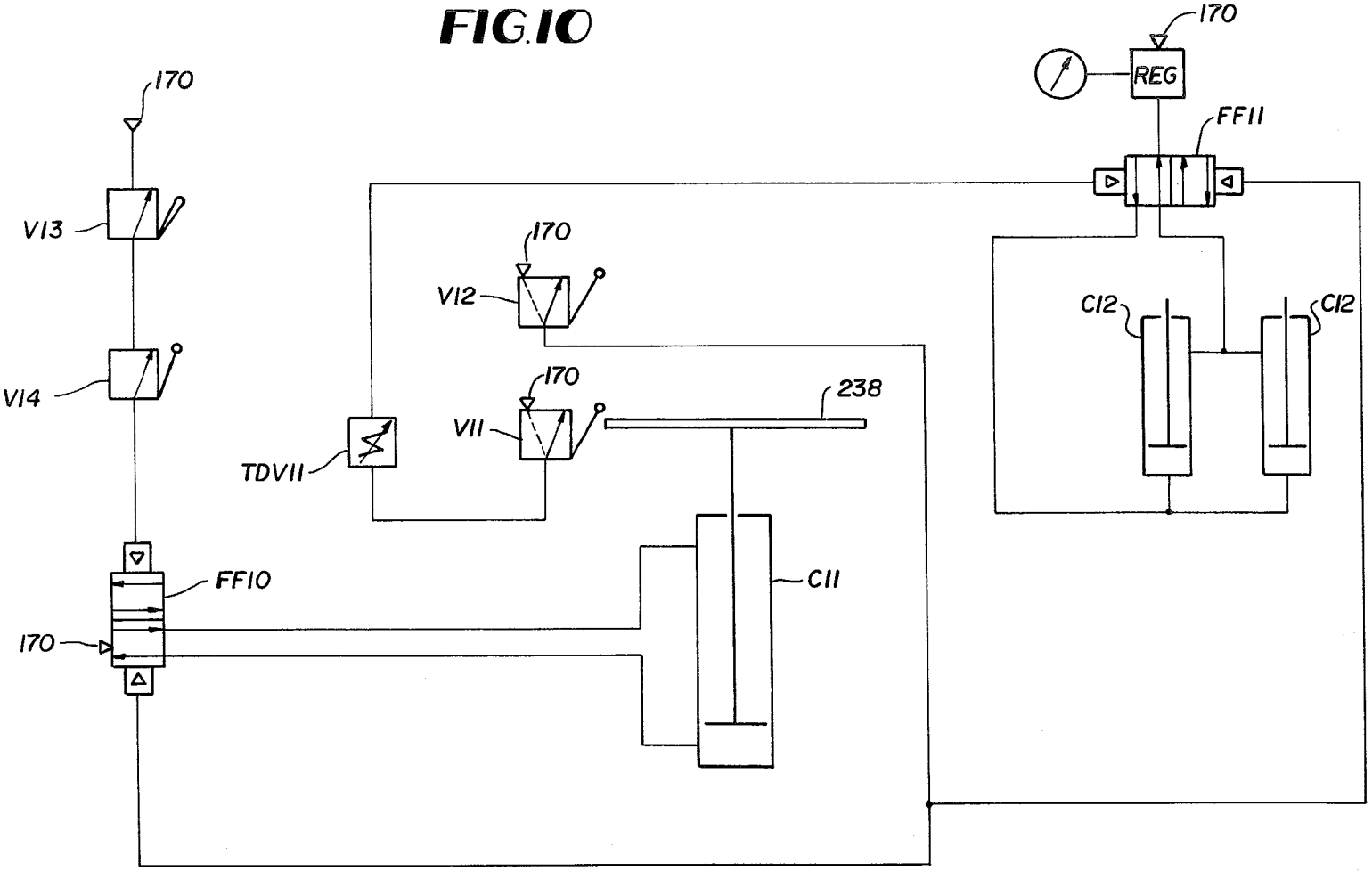
FIG. 10 is a schematic diagram of the remainder of the pneumatic circuit employed in the operation of the embodiment of FIG. 8.

The embodiment of FIGS. 9 and 10 is a simpler apparatus than that of FIGS. 1 through 8, however, the apparatus does not provide the same degree of control over the handling of the ties. As can be seen from FIG. 9, the apparatus includes a frame 200 having a rack 202 which is pivotally mounted at hinge 204 to the base of frame 200. The frame 200 also includes upright members 206, crossbar 208, and stationary arms 210 extending from the top of upright members 206 in the direction of rack 202. Stationary arms 210 have inward extensions 212 converging toward one another.

Rotatably mounted on the end of inward extensions 212 are two pivotable arms 214, which hang vertically, as shown in FIG. 9. The lower end of each pivotable arm 214 is provided with a transverse bracket 216 on which are mounted fingers 218 and 220, linked to pneumatic ram C12. The structure and operation of the fingers for this embodiment is substantially the same as for the first embodiment, described in connection with FIG. 4.

Each pivotable arm 214 is rigidly mounted on an axle 222, as is pulley 224. First cable 226 has one end tied to the periphery of pulley 224 as at 228. First cable 226 is then trained under pulley 224 and around pulley 230, pulley 232, pulley 234, pulley 236, and has its other end secured to plate 238. A second cable 240 provides a similar linkage to plate 238 for the other pivotable arm 214. The two cables are slightly longer than the path they traverse so that a slight downward displacement of plate 238 from its top position does not result in movement of arms 214, but a greater displacement does.

Between upright members 206 are provided additional crossbars 242, 244, and 245. Between crossbars 242 and 244 is mounted the cylinder of pneumatic ram C11. The piston rod 246 of pneumatic ram C11 passes through an opening in crossbar 242 and is rigidly secured to plate 238.

A vertical member 248 extends between crossbar 242 and crossbar 245. Valve V11 is mounted on member 248 near its connection to crossbar 242 and valve V12 is mounted on member 248 near its connection to crossbar 245.

Additional pneumatic components to operate the system, as will be described hereinafter can be mounted on frame 200 where convenient. As with the first embodiment, it will be apparent to those of ordinary skill that the apparatus can be assembled using electrical, electronic or hydraulic components, without departing from the scope of the inventive concept hereof. The air supply for the pneumatic system is preferably of the type shown in FIG. 5, providing a regulated output from a manifold 170.

The remaining pneumatic components for this second embodiment will be described in connection with FIG. 10. The valve V13 serves as a manually operable on-off switch to apply pressure from manifold 170 as an input to cam-operated valve V14. In this case the cam operated valve V14 is oriented on the carousel of the Adler tie tipping machine at such a position that the carousel templates will be in position for the removal of the tie ends at the appropriate time. Prior to the opening of valve V14, the apparatus is in a ready position, with the piston of ram C11 withdrawn and the piston of rams C12 retracted, so the fingers are open.

The opening of valve V14 causes flip flop FF10 to shift downwardly. Flip flop FF10 then causes the air pressure from manifold 170 to be applied to the cylinder of pneumatic ram C11 to cause it to rise, thereby lowering the arms 214. When ram C11 has traveled to its topmost position, it trips the valve V12, causing the pressure from manifold 170 to be applied to transfer flip flop FF10 upwardly and to transfer flip flop FF11 to the left.

The transfer of flip flop FF11 to the left causes rams C12 to extend their piston rods, closing the fingers. The transfer of flip flop FF10 upwardly causes ram C11 to retract its piston rod, thereby lowering plate 238. However, as noted above, first and second cables 226 and 240 are slightly longer than the path they traverse, so that the withdrawal of the piston rod of ram C11 does not begin the elevation of arms 214 until this excess length has been used up in the path lengthening caused by the piston rod retraction. This mechanically induced time delay allows the fingers 218, 220 to close before the arms 214 move.

At the bottom travel of ram C11 plate 238 trips valve V11. This tripping has the effect of applying a pulse from manifold 170 through time delay valve TDV11. As will be apparent the descent of plate 238 causes the elevation of arms 214 to a position such that the fingers rotate in the direction of arrows 270. Time delay valve TDV11 is selected to provide a sufficient period of time for the tie to come to rest once the two arms have stopped moving. Upon the expiration of TDV11, flip flop FF11 is shifted to the right, thereby causing rams C12 to retract their piston rods, opening the fingers and releasing the tie onto rack 202.

At this point the system has been returned to the ready position available for use with the next tie to be removed from the Adler tie tipping machine.

Thus it can be seen that the present invention provides a reliable, inexpensive and simple to use tie stacking apparatus.

What is claimed is:

1. An apparatus for removing flexible material from a workstation at which at least two distal portions of the flexible material are accessible to said apparatus and for stacking the flexible material for further processing, said apparatus comprising, a frame, first and second arms each having first and second ends, said first ends having pivotal mountings on said frame such that said arms may be rotated toward and away from one another and said second ends having gripping means adapted for gripping and subsequently releasing one of said distal portions of flexible material, means for rotating said arms about said pivotal mountings from a first position in which they are away from one another whereby said gripping means can grip their respective distal portions to a second position in which gripped material is extended to substantially its full length, means for receiving said material from said gripping means upon release of said material by said gripping means when said arms are in said second position, and control means for causing said gripping means to grip their respective distal portions of said material when said arms are in said first position, then for causing said rotating means to pivot said arms to their second position, then for causing said gripping means to release said distal portions, and then for causing said means for rotating to pivot said arms to said first position, whereby said material is received by said receiving means.

2. An apparatus as claimed in claim 1 further comprising means for moving said gripping means with respect to said arms and wherein said control means includes means for causing a movement elongatingly axial of said arms of each of said gripping means when said arms are in said first position prior to said gripping means gripping their respective distal portions, and for causing a foreshortening axial movement after said gripping and prior to causing said rotation of said arms from said first position to said second position.

3. An apparatus as claimed in claim 2 wherein said gripping means are pivotally mounted on said arms and a parallel linkage from said gripping means to said frame rotates said gripping means with respect to said arms as said arms rotate between said first and said second positions.

4. An apparatus as claimed in claim 1 wherein said means for receiving said material from said gripping means comprises a rack mounted on said frame, located at a lower level than but in substantially the same plane as said gripping means when said arms are in said second position.

5. An apparatus as claimed in claim 4 wherein said receiving means further comprises an auxiliary rack pivotable about a horizontal axis between a horizontal rack position and a vertical rack position and vertically movable such that said horizontal rack position is between said first mentioned rack and said material when said material is gripped by said gripping means when said arms are in said second position, means for vertically moving said auxiliary rack and means for pivoting said auxiliary rack, wherein said control means includes means for causing said auxiliary rack to move upwardly and to pivot to said horizontal rack position prior to said release of said material when said arms are in said second position, whereby upon said release, said material will be received on said auxiliary rack and includes means for causing said auxiliary rack to move downwardly after said release and then to pivot to said vertical rack position thereby depositing said material on said first mentioned rack.

6. An apparatus as claimed in claim 1 wherein said control means comprises an initiating switch operable to generate a signal to initiate operation of said control means and means connected to said initialing switch for receiving said signal and for delaying said signal prior to proceeding with later steps controlled by said control means.

7. In combination with a sewing machine for sewing lining fabric on flexible material, at least two distal portions of the flexible material being presented at the sewing machine after lining fabric has been sewn thereto, apparatus for removing the flexible material from the sewing machine after completion of the sewing operation thereon and for stacking of the flexible material for further processing, said apparatus comprising, a frame, first and second arms each having first and second ends, said first ends having pivotal mountings on said frame such that said arms may be rotated toward and away from one another and said second ends having gripping means adapted for gripping and subsequently releasing one of said distal portions of flexible material, means for rotating said arms about said pivotal mountings from a first position in which they are away from one another whereby said gripping means can grip their respective distal portions to a second position in which gripped material is extended to substantially its full length, means for receiving said material from said gripping means upon release of said material by said gripping means when said arms are in said second position, and control means for causing said gripping means to grip their respective distal portions of said material when said arms are in said first position, then for causing said rotating means to pivot said arms to their second position, then for causing said gripping means to release said distal portions, and then for causing said means for rotating to pivot said arms to said first position, whereby said material is received by said receiving means.

* * * * *